US006859189B1

(12) United States Patent
Ramirez et al.

(10) Patent No.: US 6,859,189 B1
(45) Date of Patent: Feb. 22, 2005

(54) BROADBAND ANTENNAS

(75) Inventors: Ayax D. Ramirez, Chula Vista, CA (US); Stephen D. Russell, San Diego, CA (US); Mark W. Roberts, San Diego, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 392 days.

(21) Appl. No.: 10/086,042

(22) Filed: Feb. 26, 2002

(51) Int. Cl.[7] ..... H01Q 21/12; H01Q 3/24

(52) U.S. Cl. ..... 343/815; 343/876; 250/227.18

(58) Field of Search ..... 343/815, 876, 343/745, 749; 250/227, 551

(56) References Cited

U.S. PATENT DOCUMENTS

| | | | | | |
|---|---|---|---|---|---|
| 4,001,773 | A | * | 1/1977 | Lamel et al. | 367/82 |
| 4,368,385 | A | | 1/1983 | Kanbe et al. | |
| 4,369,371 | A | | 1/1983 | Hara et al. | |
| 4,376,285 | A | | 3/1983 | Leonberger et al. | |
| 4,546,249 | A | | 10/1985 | Whitehouse et al. | |
| 4,835,500 | A | * | 5/1989 | Sequeira | 333/258 |
| 5,029,306 | A | * | 7/1991 | Bull et al. | 342/368 |
| 5,293,172 | A | | 3/1994 | Lamberty et al. | |
| 5,402,259 | A | * | 3/1995 | Lembo et al. | 359/245 |
| 5,565,879 | A | * | 10/1996 | Lamensdorf | 343/781 R |
| 5,719,975 | A | * | 2/1998 | Wolfson et al. | 385/48 |
| 5,731,790 | A | * | 3/1998 | Riza | 342/368 |
| 6,417,807 | B1 | * | 7/2002 | Hsu et al. | 343/700 MS |

OTHER PUBLICATIONS

Rogers, Dennis L., "Monolithic Integration of a 3–GHZ Detector/Preamplifier Using a Refractory—Gate, Ion—Implanted MESFET Process", IEEE Electron Device Letters, 1996, EDL–7, pp. 600–602, U.S.

Albares, D.J., Garcia, G.A., Chang, C.T., and Reedy, R.E., "Optoelectronic Time Division Multiplexing", Electronic Letters, 1987, 23, pp. 327–328, U.S.

Mendelson, V.L., Kozlov, A.I., and Finkelshteyn, M.I., "Some Electrodynamic Models of Ice Sheets, Useful in Radar Sounding Problems", Izvestiya Akademii Nauk SSR, Fizika Atmosfery I Okanea, 1972, 8, pp. 396–402, USSR (translated in Izvestiya Academy of Sciences USSR, Atmospheric and Oceanic Physics, 1972, pp. 225–229).

* cited by examiner

*Primary Examiner*—Tan Ho
(74) *Attorney, Agent, or Firm*—Celia C. Dunham; Michael A. Kagan; Peter A. Lipovsky

(57) ABSTRACT

The fast switching multifunction antenna of the present invention is a variable length antenna that may be switched to provide the equivalent function of a broadband antenna. The variable length antenna quasi-continuously transmits or receives signals at a plurality of frequencies by changing the effective length of the antenna using a variety of switching mechanisms. The present invention may comprise a plurality of antenna segments, a plurality of selectively actuable switches for interconnecting the antenna segments, and a switching mechanism operably coupled to the plurality of selectively actuable switches for switching them at a switching rate that is greater than twice the highest frequency to be transmitted or received. The switching rate will be fast enough to allow the antenna to sample the highest frequency and all of the required lower frequencies within the desired frequency range without the loss of information at any frequency. However, the switching rate is slow enough to allow sampling of the frequency at each antenna length before the next antenna length is activated.

20 Claims, 6 Drawing Sheets

BROADBAND ANTENNAS

DOCUMENTS INCORPORATED BY REFERENCE

The following documents are hereby incorporated by reference into this specification: Rogers, Dennis L., "Monolithic Integration of a 3-GHz Detector/Preamplifier Using a Refractory-Gate, Ion-Implanted MESFET Process", IEEE Electron Device Letters, 1996, EDL-7, pp. 600–602; Albares, D. J., Garcia, G. A., Chang, C. T., and Reedy, R. E., "Optoelectronic Time Division Multiplexing", Electronic Letters, 1987, 23, pp. 327–328; and Mendel'son, V. L., Kozlov, A. I., and Finkel'shteyn, M. I., "Some Electrodynamic Models of Ice Sheets, Useful in Radar-Sounding Problems", Izvestiya Akademii Nauk SSR, Fizika Atmosfery I Okanea, 1972, 8, pp. 396–402 [translated in Izvestiya Academy of Sciences USSR, Atmospheric and Oceanic Physics, 1972, pp 225–229].

BACKGROUND OF THE INVENTION

Numerous scientific, civilian, and military applications require both narrowband and broadband communications. In typical applications, space and/or weight are at a premium and multiple frequency operation is necessary. Under these circumstances, using multiple antennas or larger broadband antennas is not practical. The use of a single antenna would eliminate cross-talk problems typically affecting multi-antenna systems, especially critical in shipboard and aircraft systems.

When limited space is a factor and multiple frequency operation is necessary, reconfigurable antennas provide flexibility in operating frequency, bandwidth, and radiation pattern performance. To be reconfigurable, prior designs have implemented optoelectronic or microelectromechanical systems (MEMS) switches placed along the antenna for control and sampling of electrical signals. These devices are ideal for reconfiguring antennas to different lengths, allowing for multifunctioning of the antennas. In particular, there is a need to have broadband antennas that can be reconfigured into narrowband antennas with high gain or high directionality and back to broadband for some applications.

A prior art concept is depicted schematically in FIG. 1, where optoelectronic switches 12*a*, 12*b*, 14*a*, and 14*b* interconnect dipole antenna 20 with antenna segments 22*a*, 22*b*, 24*a*, and 24*b*. The activating light is provided via optical fibers 30, resulting in complete isolation of the optoelectronic switches 12*a*, 12*b*, 14*a*, and 14*b*. When the light sources 40 and 42 are in a non-emissive state, antenna segments 22*a*, 22*b*, 24*a*, and 24*b* are inactive and dipole antenna 20 has a length L with output frequency F1 at time t1. When light source 40 is placed in an emissive state, optoelectronic switches 12*a*and 12*b* are actuated, thereby activating antenna segments 22*a* and 22*b* to form a dipole antenna with length 2L and output frequency F2 at time t2. When light source 42 is placed in an emissive state, while light source 40 is also in an emissive state, optoelectronic switches 14*a* and 14*b* are actuated, thereby activating antenna segments 24*a* and 24*b* to form a dipole antenna with length 3L and output frequency F3 at time t3. The disadvantage of this system, however, is that the antenna effectively samples only one frequency at a time. During the time that this one frequency is being observed, all of the information transmitted or received at other frequencies is lost. Thus, there is a need for a variable length antenna that may be switched to allow fast sampling over an entire frequency range, providing the equivalent frequency coverage of a broadband antenna while maintaining the high efficiency of a narrowband antenna.

SUMMARY OF THE INVENTION

The present invention is a variable length antenna that may be switched to provide the equivalent function of a broadband antenna. It is an apparatus and method for quasi-continuously transmitting or receiving signals at a plurality of frequencies by changing the effective length of the antenna using a variety of switching mechanisms. The antenna of the present invention may comprise a plurality of antenna segments, a plurality of selectively actuable switches for interconnecting the antenna segments, and a switching mechanism operably coupled to the plurality of selectively actuable switches for switching them at a switching rate that is greater than twice the highest frequency to be transmitted or received. This rate will be fast enough to allow the antenna to sample the highest frequency and all of the required lower frequencies within the desired frequency range without the loss of information at any frequency. The switching rate is slow enough, however, to allow sampling of the frequency at each antenna length before the next antenna length is activated.

An example of a variable length antenna in accordance with the present invention comprises a plurality of antenna segments, a plurality of selectively actuable switches for interconnecting the antenna segments, a switch controller, and at least one light source. The light source(s), such as lasers, pulsed lasers, light-emitting diodes (LEDs) and diode lasers, may be operably coupled to the actuable switches by a variety of means, including optical fibers, optical waveguides, optical switches, light valves, or optical MEMS devices. The switch controller selects and switches the light source(s) from a non-emissive state to an emissive state or from an emissive to a non-emissive state. As the switch controller places each light source in an emissive state, the actuable switches are selectively actuated, thereby activating selected antenna segments and changing the length and effective frequency of the antenna. When the variable length antenna has cycled through the desired transmit or receive frequency range, the light source(s) is/are returned to a non-emissive state and the sampling process repeats.

Another example of a variable length antenna in accordance with the present invention comprises a plurality of antenna segments, a plurality of selectively actuable switches for interconnecting the antenna segments, a switching device operably coupled to at least one light source for actuating the plurality of actuable switches, and a delay mechanism operably coupled to said at least one light source for effecting delay in actuating the plurality of selectively actuable switches. The delay mechanism may comprise optical retarders operably coupled to optical fibers to change the effective lengths of the optical fibers. Alternatively, the physical lengths of optical fibers may be varied to achieve the same delay effects of optical fibers. The switching device simultaneously switches the light source(s) from a non-emissive state to an emissive state or from an emissive to a non-emissive state. When the variable length antenna is activated, the switch device simultaneously places each light source in an emissive state. The optical retarders introduce different amounts of time delay into the optical fibers, the actuable switches are sequentially activated and thereby activating selected antenna segments and increasing the length and effective wavelength of the antenna. When the variable length antenna has cycled through the desired transmit or receive frequency range, the light sources are returned to a non-emissive state and the sampling process repeats.

Yet another example of a variable length antenna in accordance with the present invention comprises a plurality of antenna segments, a plurality of selectively actuable switches for interconnecting the antenna segments, a light source operably coupled to a switching device, at least one diffraction grating operably coupled to the light source, and a delay mechanism operably coupled to said at least one diffraction grating for effecting delay in actuating said plurality of selectively actuable switches. The switching device switches the light source from a non-emissive to an emissive state or from an emissive to a non-emissive state. When the light source is placed in an emissive state, the light passes through the diffraction grating(s) to produce a plurality of new light sources after diffraction. Each new light source then selectively actuates the actuable switches to activate corresponding antenna segments and change the effective length of the antenna.

In accordance with the present invention, transmitting or receiving signals at a plurality of frequencies may be accomplished by employing conductive fluid to change the effective length of the antenna. The antenna may comprise a plurality of antenna segments, each of which comprises a dielectric container for holding a conductive fluid. In this embodiment, the antenna may further comprise a reservoir connected to the antenna segments and a pressure regulator system for controlling the pressure in the antenna segments. As the pressure in the antenna segments changes, the effective length of the antenna changes. This allows the antenna to be tuned to both harmonically related and non-harmonically related frequencies.

In accordance with other aspects of the present invention, transmitting or receiving signals at a plurality of frequencies may be accomplished by using an electromagnetic beam to change the effective length of the antenna. The antenna may comprise a plurality of antenna segments and a source of at least one electromagnetic beam for effectively decoupling the antenna segments. Illuminating a section of the antenna segment with an electromagnetic beam decouples the segment of the antenna beyond the point of illumination from the rest of the antenna and, thus, changes the effective length of the antenna. When the section is no longer illuminated with an electromagnetic beam, it recouples to the rest of the antenna.

An important advantage of this invention is that it provides a broadband antenna using a single variable length antenna, thus simplifying the construction of antenna arrays. This feature is important because RF communications systems may employ one antenna embodying various features of the present invention instead of multiple antennas, which would otherwise be necessary to cover the same bandwidth. This antenna is expected to find wide applications in communications applications, particularly on board ships and airplanes.

Moreover, the broadband sampling technique of the present invention has applications beyond conventional communications systems. For example, the multi-frequency aspects of the invention will allow applications of electromagnetic sounding for surveillance and non-destructive testing. One such application in radar sounding is described in Mendel'son et al mentioned above.

These and other advantages of the invention will become more readily apparent upon review of the following description, taken in conjunction with the accompanying figures and claims.

DESCRIPTION OF SOME EMBODIMENTS

The following description presents some embodiments currently contemplated for practicing the present invention. This description is not to be taken in a limiting sense, but is presented solely for the purpose of some embodiments of disclosing how the present invention may be made and used. The scope of the invention should be determined with reference to the claims.

Figure 1:
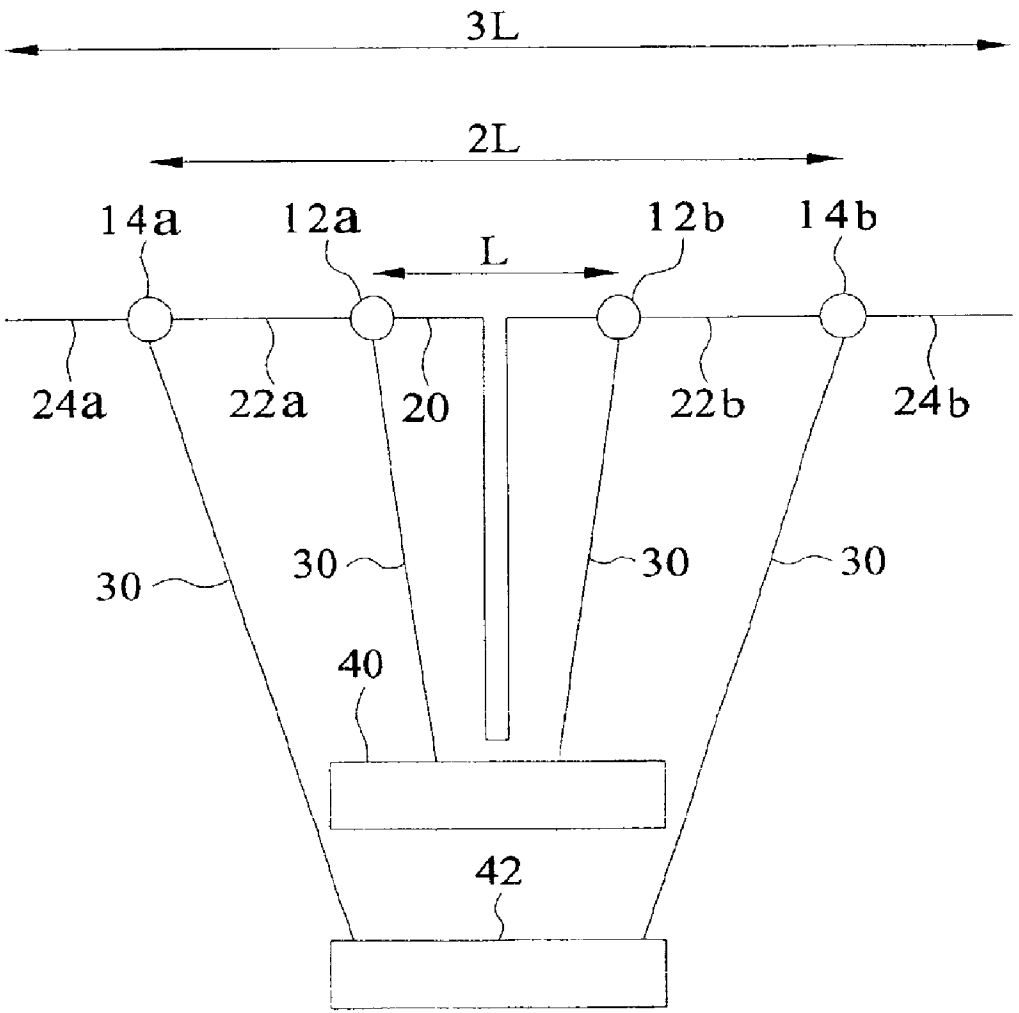
FIG. 1 PRIOR ART
FIG. 1 is a schematic of a prior art reconfigurable antenna.
Figure 2:
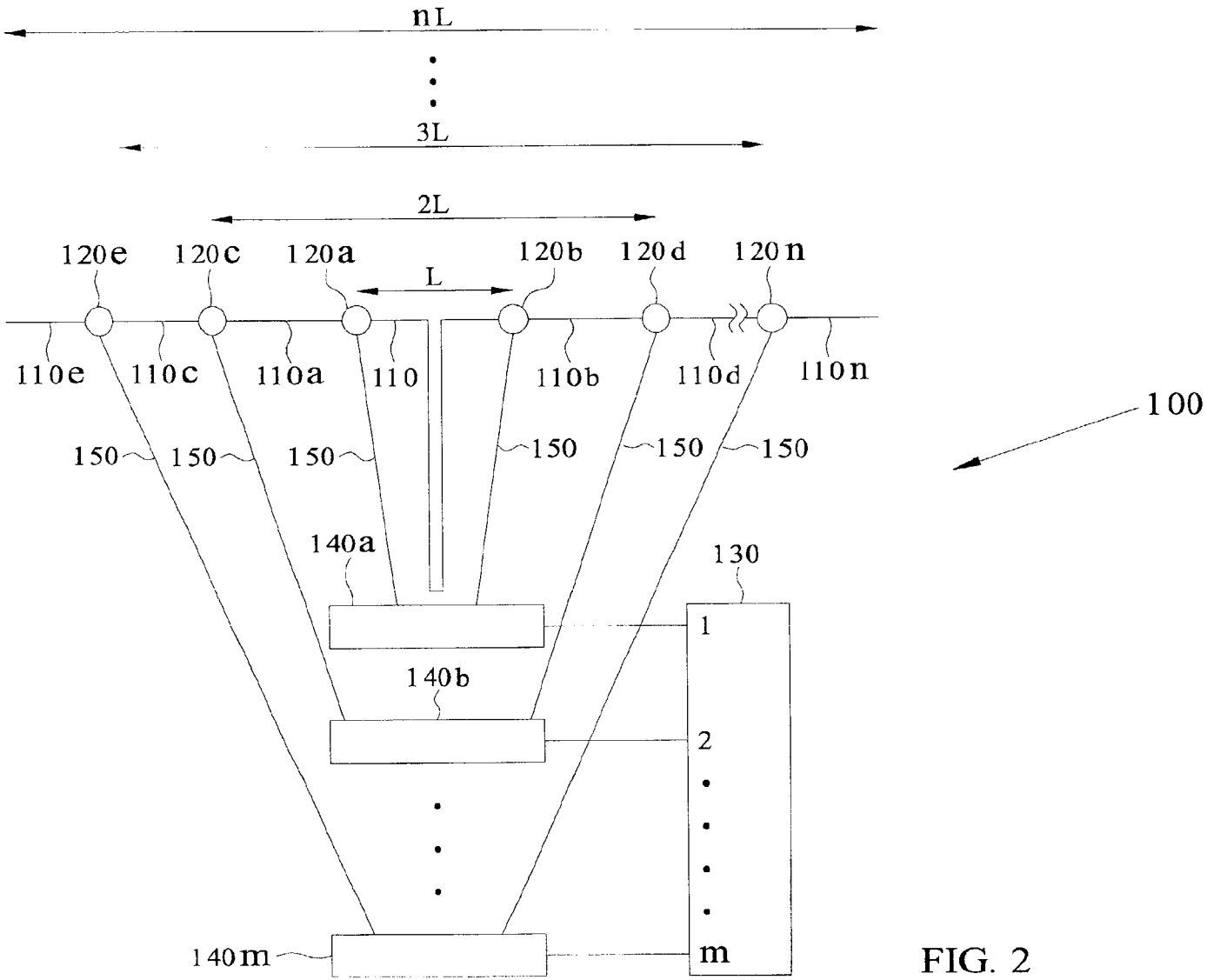
FIG. 2 is a schematic drawing of the first embodiment of a variable length antenna for transmitting or receiving at a plurality of frequencies in accordance with the present invention.

FIG. 2 shows a first embodiment of a variable length antenna for transmitting or receiving at a plurality of frequencies in accordance with the present invention. In this embodiment, variable length antenna 100 comprises a plurality of antenna segments 110, 110*a*, 110*b*, 110*c*, 110*d*, 110*e*, . . . , 110*n*, a plurality of selectively actuable switches 120*a*, 120*b*, 120*c*, 120*d*, 120*e*, . . . , 120*n*, a switch controller 130, and a plurality of light sources 140*a*, 140*b*, . . . , 140*m*. As contemplated in this embodiment, light sources 140*a*, 140*b*, . . . , 140*m*, such as lasers, pulsed lasers, light emitting diodes (LEDs), and diode lasers, are operably coupled to switches 120*a*, 120*b*, 120*c*, 120*d*, 120*e*, . . . , 120*n* via optical fibers 150. However, other means, such as optical waveguides, optical switches, light valves, and optical MEMs devices, may also be used to couple light sources 140*a*, 140*b*, . . . , 140*m* to switches 120*a*, 120*b*, 120*c*, 120*d*, 120*e*, 120*n*. Switch controller 130 selects light sources 140*a*, 140*b*, . . . , 140*m* and switches them from a non-emissive to an emissive state or from an emissive to a non-emissive state. When light sources 140*a*, 140*b*, . . . , 140*m* are in a non-emissive state, antenna segments 110*a*, 110*b*, 110*c*, 110*d*, 110*e*, . . . , 110*n* are inactive and variable length antenna 100 has a length L with output frequency F1. Switch controller 130 sequentially selects and switches light sources 140*a*, 140*b*, . . . , 140*m* from a nonemissive state to an emissive state. As each of the light sources 140*a*, 140*b*, . . . , 140*m* are switched to an emissive state, switches 120*a*, 120*b*, 120*c*, 120*d*, 120*e*, . . . , 120*n* are actuated to activate corresponding antenna segments 110*a*, 110*b*, 110*c*, 110*d*, 110*e*, . . . , 110*n* and increase the effective length of variable length antenna 100. Thus, when light source 140*a* is placed in an emissive state, switches 110*a* and 120*b* are actuated, thereby activating antenna segments 100*a* and 110*b* to form a dipole antenna with length 2L and output frequency F2.

Next, switch controller 130 places light source 140*b* in an emissive state which actuates switches 120*c* and 120*d*, thereby activating antenna segments 110*c* and 110*d* to form a dipole antenna with length 3L and output frequency F3. Finally, switch controller 130 places light source 140*m* in an emissive state which actuates switches 120*e* and 120*n*, thereby activating antenna segments 110*e* and 110*n* to form a dipole antenna with length nL and output frequency Fm. When variable length antenna 100 has cycled through the desired frequency range, switch controller 130 returns light sources 140*a*, 140*b*, . . . , 140*m* to a non-emissive state, and the sampling process repeats. When the required switching and sampling times are met, variable length antenna 100 resembles a broadband antenna, with the advantage of using a single highly efficient dipole antenna.

Figure 3:
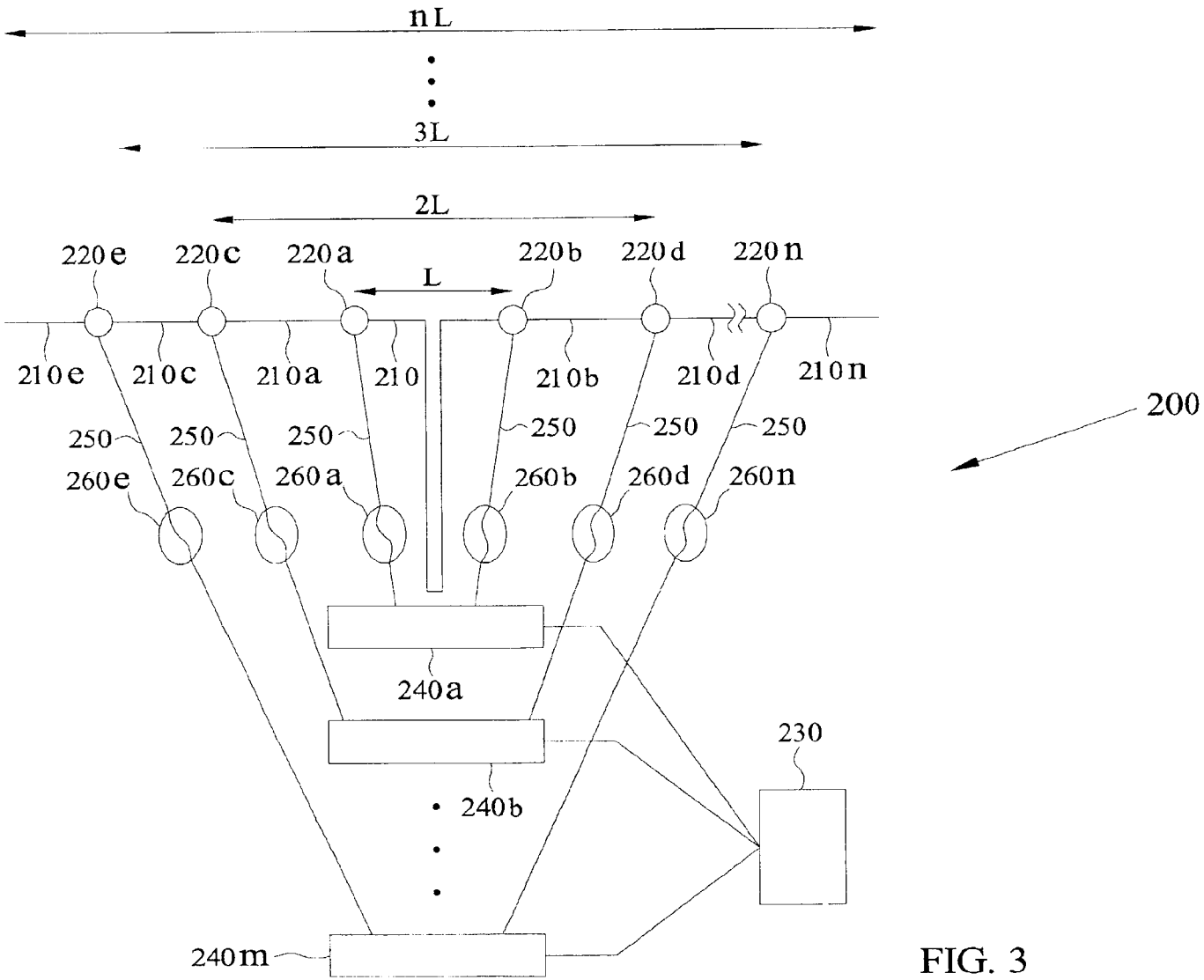
FIG. 3 is a schematic drawing of a second embodiment of a variable length antenna for transmitting or receiving at a plurality of frequencies in accordance with the present invention.

A second embodiment of a variable length antenna for transmitting or receiving at a plurality of frequencies in accordance with the present invention is shown in FIG. 3. In this embodiment, variable length antenna 200 comprises a plurality of antenna segments 210, 210*a*, 210*b*, 210*c*, 210*d*, 210*e*, . . . , 210*n*, a plurality of selectively actuable switches 220*a*, 220*b*, 220*c*, 220*d*, 220*e*, 220*n*, a switching device 230, and a plurality of light sources 240*a*, 240*b*, . . . , 240*m*. Optical fibers 250 operably couple light sources 240*a*, 240*b*, . . . , 240*m* to actuable switches 220*a*, 220*b*, 220*c*, 220*d*, 220*e*, . . . , 220*n*. As with the first embodiment, other means of operably coupling light sources 240*a*, 240*b*, . . . , 240*m* to actuable switches 220*a*, 220*b*, 220*c*, 220*d*, 220*e*, . . . , 220*n* may be used, including optical waveguides, optical switches, light valves, and optical MEMs devices. In this embodiment, switching device 230 simultaneously switches light sources 240*a*, 240*b*, . . . , 240*m* from a non-emissive to an emissive state or from an emissive to a non-emissive state. In addition, this embodiment of the present invention includes the use of optical retarders 260*a*, 260*b*, 260*c*, 260*d*, 260*e*, . . . , 260*n* coupled to optical fibers 250 to change the effective lengths of optical fibers 250. Alternatively, the physical lengths of optical fibers 250 may be varied to introduce delay in the optical fibers 250 and achieve the same effects of using optical retarders 260*a*, 260*b*, 260*c*, 260*d*, 260*e*, . . . , 260*n*. When light sources 240*a*, 240*b*, . . . , 240*m* are in a non-emissive state, antenna segments 210*a*, 210*b*, 210*c*, 210*d*, 210*e*, . . . , 210*n* are inactive and variable length antenna 200 has a length L with output frequency F1. Switching device 230 simultaneously switches light sources 240*a*, 240*b*, . . . , 240*m* from a non-emissive state to an emissive state. Optical retarders 260*a* 260*b*, 260*c*, 260*d*, 260*e*, . . . , 260*n* introduce different amounts of delay into optical fibers 250 to sequentially actuate switches 220*a*, 220*b*, 220*c*, 220*d*, 220*e*, . . . , 220*n*. Switches 220*a*, 220*b*, 220*c*, 220*d*, 220*e*, . . . , 220*n* are selectively actuated to activate corresponding antenna segments 110, 110*a*, 110*b*, 110*c*, 110*d*, 110*e*, . . . , 110*n* and increase the effective length of the antenna. Thus, when all light sources 240*a*, 240*b*, . . . , 240*m* are placed in an emissive state, switches 220*a* and 220*b* are actuated first, thereby activating antenna segments 210*a* and 210*b* to form a dipole antenna with length 2L and output frequency F2. Next, switches 220*c* and 220*d* are actuated, thereby activating antenna segments 210*c* and 210*d* to form a dipole antenna with length 3L and output frequency F3. Finally, switches 220*e* and 220*n* are actuated, thereby activating antenna segments 210*e* and 210*n* to form a dipole antenna with length nL and output frequency Fm. When variable length antenna 200 has cycled through the desired frequency range, switching device 230 returns light sources 240*a*, 240*b*, . . . , 240*m* to a nonemissive state, and the sampling process repeats. As with the first embodiment, when the required switching and sampling times are met in this embodiment, variable length antenna 200 resembles a broadband antenna, with the advantage of using a single highly efficient dipole antenna.

Figure 4:
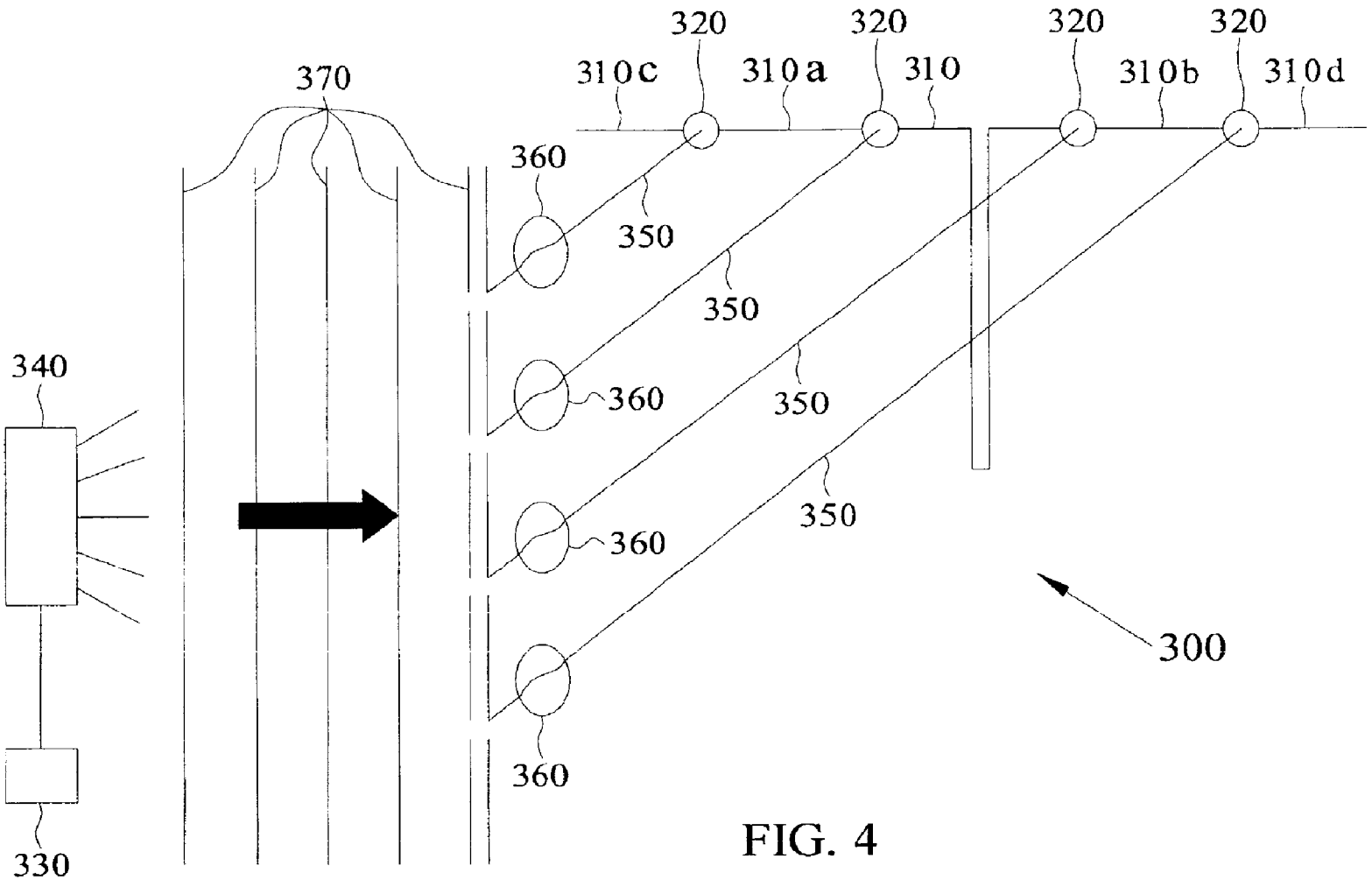
FIG. 4 is a schematic drawing of a third embodiment of a variable length antenna for transmitting or receiving at a plurality of frequencies in accordance with the present invention.

FIG. 4 shows a third embodiment of a variable length antenna for transmitting or receiving at a plurality of frequencies in accordance with the present invention. Variable length antenna 300 comprises a plurality of antenna segments 310, 310*a*, 310*b*, 310*c*, and 310*d*, a plurality of selectively actuable switches 320, a switching device 330 operably coupled to a single multi-wavelength light source 340, and a plurality of diffraction gratings 370. In this embodiment of the present invention, switching device 330 switches the single light source 340 from a non-emissive to an emissive state or from an emissive to a non-emissive state. When light source 340 is placed in an emissive state, the light passes through diffraction gratings 370 and produces a plurality of new light sources after diffraction. As with the second embodiment, this embodiment employs the use of optical retarders 360 to introduce delay and change the effective lengths of optical fibers 350. The physical lengths of optical fibers 350 may also be varied to achieve the same delay effects of optical retarders 360. Thus, switches 320 are sequentially actuated to activate corresponding antenna segments 310*a*, 310*b*, 310*c*, and 310*d* and increase the effective length of variable length antenna 300.

Figure 5:
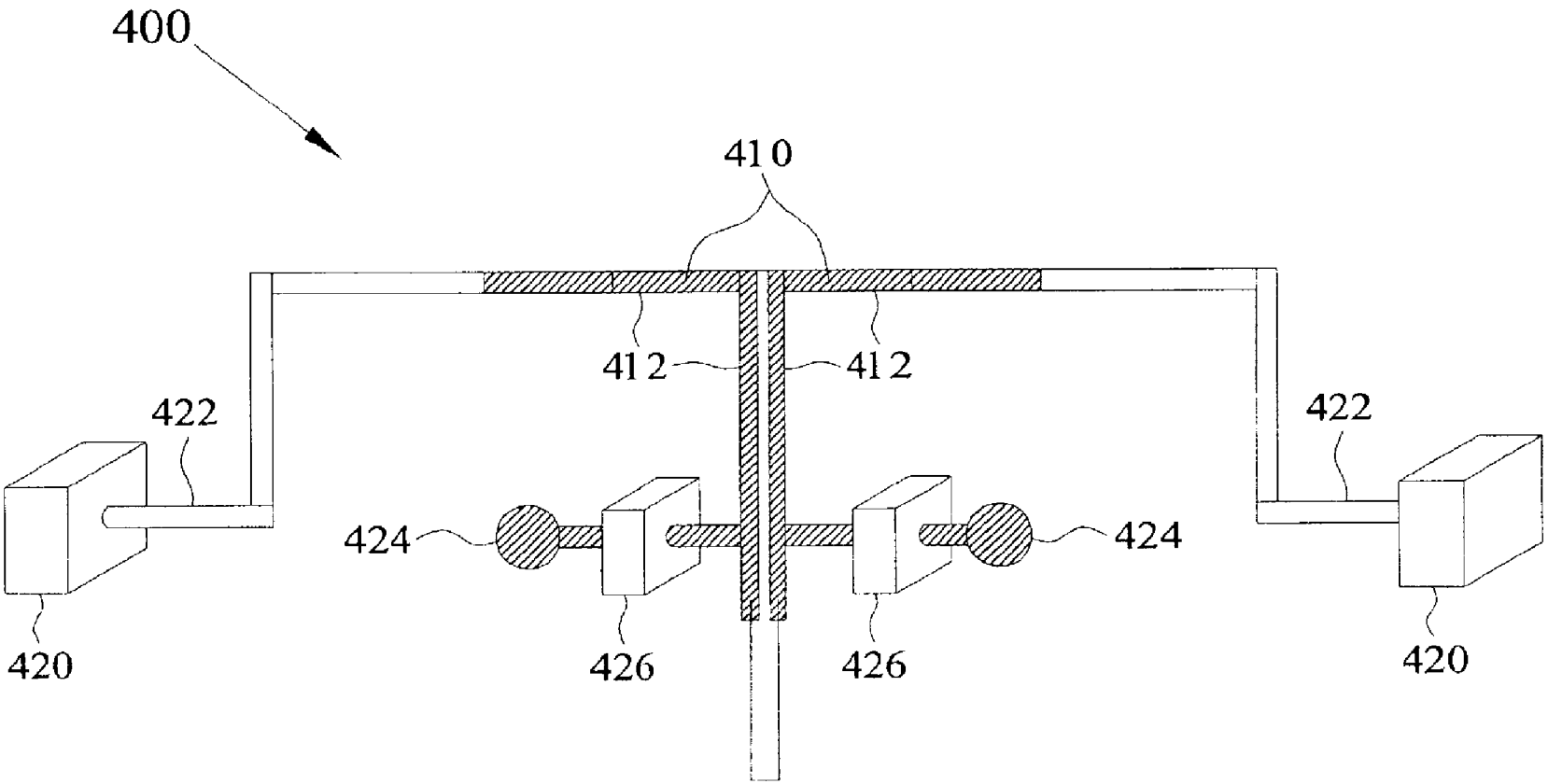
FIG. 5 is a schematic drawing of a fourth embodiment of a variable length antenna for transmitting or receiving at a plurality of frequencies in accordance with the present invention.

FIG. 5 shows another embodiment of a variable length antenna for transmitting or receiving at a plurality of frequencies in accordance with the present invention. Variable length antenna 400 is a pressure-driven liquid antenna comprising two separate liquid metal columns 410, each held in its own dielectric tube 412. The pressure in the dielectric tubes 412 is controlled by a pressure regulator system comprising of pumps 420 operably coupled to one end of the dielectric tubes 412 via hoses 422 and reservoirs 424 for holding excess conductive fluid 410. Additional pumps 426 may operably couple the reservoirs 424 to the dielectric tubes 412. Increasing the pressure in the dielectric tubes 412 in conjunction with pumping conductive fluid 410 into the reservoirs 424 shortens the length of the antenna 400. Reducing the pressure in the dielectric tubes 412 in conjunction with pumping conductive fluid 410 from the reservoir 424 lengthens the antenna. This embodiment of the present invention may be readily formed using microfabrication techniques such as those used in microfluidic and MEMS processing. In such cases, channels may be formed in dielectric material that can provide the form or structure for the antenna.

Figure 6:
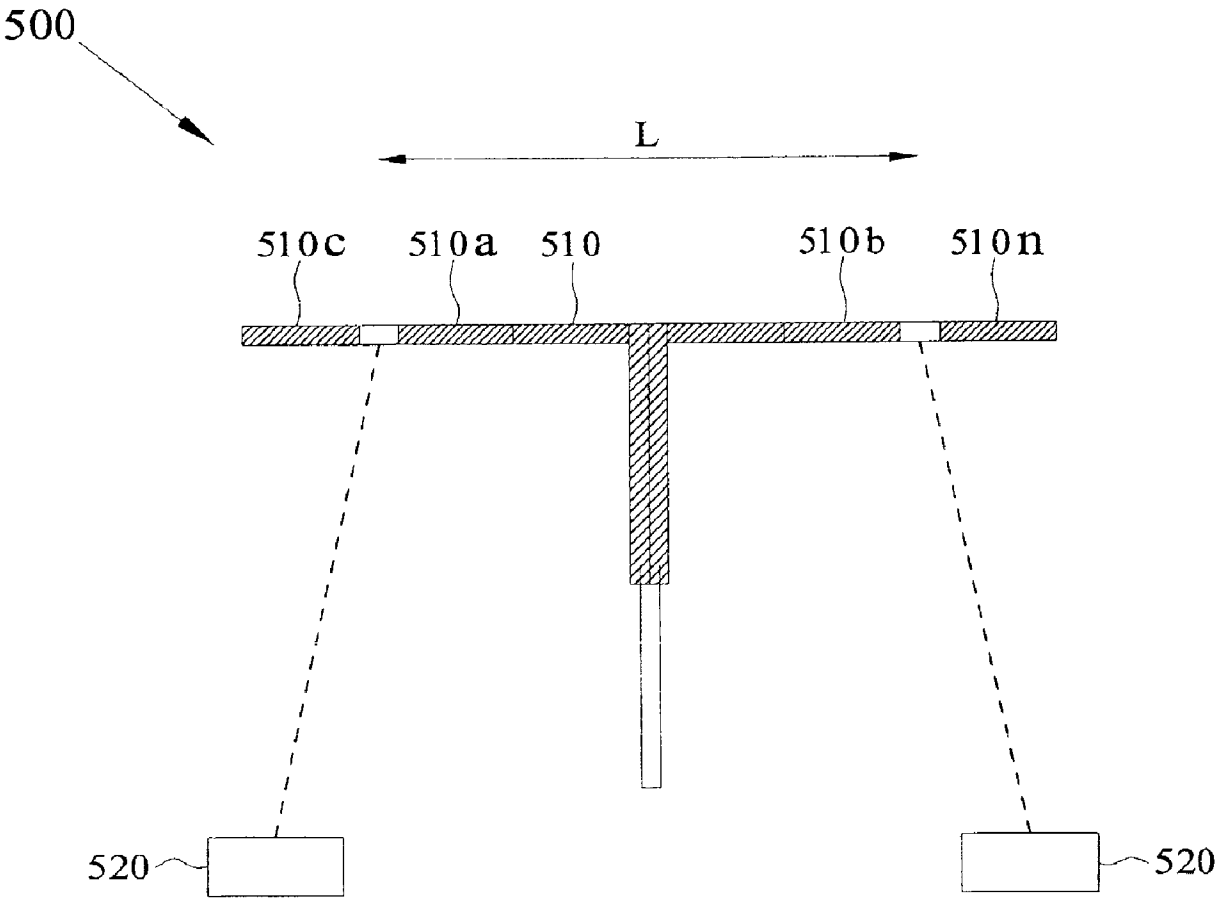
FIG. 6 is a schematic drawing of a fifth embodiment of a variable length antenna for transmitting or receiving at a plurality of frequencies in accordance with the present invention.

Another embodiment of a variable length antenna for transmitting or receiving at a plurality of frequencies in accordance with the present invention is shown in FIG. 6. In this embodiment, variable length antenna 500 comprises a plurality of antenna segments 510, 510*a*, 510*b*, 510*c*, . . . , 510*n*, and a source of at least one electromagnetic beam 520 for decoupling antenna segments 510, 510*a*, 510*b*, 510*c*, . . . , 510*n*. Illuminating a section of the variable length antenna 500 with an electromagnetic beam decouples the segment of the antenna beyond the point of illumination from the rest of the antenna and, thus, varies the effective length of the antenna. To decouple an antenna segment, the intensity of the electromagnetic beam 520 must be sufficient to overwhelm any rf signal on the antenna at the point of beam illumination. Two possible sources for the electromagnetic beams are the hydrogen cyanide (HCN) laser, which has a frequency of 890 GHz, and the hydrogen atom maser, which has a frequency of 1.42 GHz.

An important aspect of the variable length antenna for transmitting or receiving at a plurality of frequencies is the flexibility in its range of frequencies. The number of actuable switches and antenna segments may be increased or decreased depending on the desired frequency range. Moreover, the operation of the variable length antenna is not limited to sequentially transmitting or receiving frequencies within the frequency range. The present invention may be operated to transmit or receive frequencies in any desired sequence within its frequency range. Finally, this concept may be applied to other radiating apertures including, but not limited to, slots, spirals, and the like.

Obviously, many modifications and variations of the invention are possible in light of the above teachings. It is therefore to be understood that within the scope of the appended claims the invention may be practiced otherwise than as has been specifically described.

We claim:

1. A broadband antenna for transmitting or receiving signals at a plurality of frequencies comprising:

a plurality of antenna segments;

a plurality of selectively actuable switches for interconnecting said antenna segments; and a switching mechanism operably coupled to said plurality of selectively actuable switches for actuating said plurality of switches at a switching rate that is greater than two times the highest of said plurality of frequencies.

2. The broadband antenna according to claim 1 wherein said switching mechanism comprises:

a switch controller; and at least one light source operably coupled to said switch controller.

3. The broadband antenna according to claim 2 wherein said switch controller switches said at least one light source from a non-emissive to an emissive state or from an emissive to a non-emissive state.

4. The broadband antenna according to claim 3 wherein said at least one light source sequentially actuate said actuable switches at said switching rate.

5. The broadband antenna according to claim 1 wherein said switching mechanism comprises:

a switching device;

at least one light source operably coupled to said switching device; and a delay mechanism operably coupled to said at least one light source for effecting delay in actuating said plurality of selectively actuable switches.

6. The broadband antenna according to claim 5 wherein said switching device simultaneously switches said at least one light source from a non-emissive to an emissive state or from an emissive to a non-emissive state.

7. The broadband antenna according to claim 6 wherein said delay mechanism comprises a plurality of optical fibers and wherein each of said plurality of optical fibers has a different physical length with respect to the other optical fibers.

8. The broadband antenna according to claim 6 wherein said delay mechanism comprises a plurality of optical fibers and a plurality of optical retarders operably coupled to said plurality of optical fibers for changing the effective length.

9. The broadband antenna according to claim 1 wherein said switching mechanism comprises:

a switching device;

a single light source operably coupled to said switching device;

at least one diffraction grating operably coupled to said light source; and a delay mechanism operably coupled to said at least one diffraction grating for effecting delay in actuating said plurality of selectively actuable switches.

10. The broadband antenna according to claim 9 wherein said switching device switches said single light source from a non-emissive to an emissive state or from an emissive to a non-emissive state.

11. The broadband antenna according to claim 10 wherein said single light source is a multi-wavelength light source.

12. The broadband antenna according to claim 10 wherein said at least one diffraction grating diffract light from said light source to produce a plurality of light sources.

13. The broadband antenna according to claim 10 wherein said delay mechanism comprises a plurality of optical fibers and wherein each of said plurality of optical fibers has a different physical length with respect to the other optical fibers.

14. The broadband antenna according to claim 10 wherein said delay mechanism comprises a plurality of optical fibers and a plurality of optical retarders operably coupled to said plurality of optical fibers for changing the effective length.

15. The broadband antenna according to claim 1 wherein each of said plurality of antenna segments comprises a dielectric container for holding a conductive fluid and wherein said variable length antenna further comprises:

a conductive fluid;

a reservoir operably coupled to said plurality of dielectric containers for holding said conductive fluid; and a pressure regulator system operably coupled to said plurality of dielectric containers for controlling the pressure in said plurality of dielectric containers.

16. The broadband antenna according to claim 15 wherein said pressure regulator system comprises devices operably coupled to said plurality of dielectric containers for controlling the pressure in said plurality of dielectric containers.

17. A broadband antenna for transmitting or receiving signals at a plurality of frequencies comprising:

a plurality of antenna segments; and a source of at least one electromagnetic beam for decoupling said antenna segments to change the frequency of operation.

18. The broadband antenna according to claim 17 wherein said source of at least one electromagnetic beam comprises at least one high frequency electromagnetic beam source.

19. The broadband antenna according to claim 18 one electromagnetic beam comprises a hydrogen cyanide (HCN) laser.

20. The broadband antenna according to claim 18 wherein said source of at leasts one electromagnetic beam comprises a hydrogen atom maser.

* * * * *